US011905713B2

(12) United States Patent
Lehmann et al.

(10) Patent No.: US 11,905,713 B2
(45) Date of Patent: Feb. 20, 2024

(54) COUPLING SYSTEM FOR MOUNTING TILES TO A BUILDING

(71) Applicant: Hunter Douglas Inc., Pearl River, NY (US)

(72) Inventors: Christian Lehmann, Marblehead, MA (US); Xiang Li, Shanghai (CN)

(73) Assignee: Hunter Douglas Inc., Pearl River, NY (US)

( * ) Notice: Subject to any disclaimer, the term of this patent is extended or adjusted under 35 U.S.C. 154(b) by 296 days.

(21) Appl. No.: 17/604,591

(22) PCT Filed: Apr. 15, 2020

(86) PCT No.: PCT/US2020/028196
§ 371 (c)(1),
(2) Date: Oct. 18, 2021

(87) PCT Pub. No.: WO2020/223012
PCT Pub. Date: Nov. 5, 2020

(65) Prior Publication Data

US 2022/0195736 A1 Jun. 23, 2022

Related U.S. Application Data

(60) Provisional application No. 62/840,482, filed on Apr. 30, 2019.

(51) Int. Cl.
*E04F 13/08* (2006.01)
*E04F 13/14* (2006.01)

(52) U.S. Cl.
CPC ..... *E04F 13/0826* (2013.01); *E04F 13/0862* (2013.01); *E04F 13/0891* (2013.01); *E04F 13/0892* (2013.01); *E04F 13/142* (2013.01)

(58) Field of Classification Search
CPC ..... E04F 13/0826; E04F 13/0862; E04F 13/0892; E04F 13/0821; E04F 13/0803; E04F 13/0805
(Continued)

(56) References Cited

U.S. PATENT DOCUMENTS 2,043,706 A 6/1936 Myers
3,672,112 A 6/1972 Sions
(Continued)

FOREIGN PATENT DOCUMENTS

DE 20200530 U1 5/2002
DE 102008024992 A1 11/2009
(Continued)

OTHER PUBLICATIONS

Author Unknown, "Terracotta", Eco Cladding Engineering, retrieved Dec. 19, 2018. URL: https://www.ecocladding.com/system/terracotta.

(Continued)

*Primary Examiner* — Brent W Herring
(74) *Attorney, Agent, or Firm* — KDW Firm PLLC

(57) ABSTRACT

A coupling system for mounting a tile to an outer surface of a building is disclosed. In one embodiment, the coupling system includes support tracks arranged and configured to couple the tile to the building. The support tracks may include integrally formed clips for coupling with the tiles. The clips may be arranged and configured to couple to a top portion of a lower tile and a bottom portion of an upper tile. Additionally, and/or alternatively, the coupling system may include a gasket coupled to the support tracks. The gasket may include first and second arms. The support tracks may include integrally formed, first and second inwardly extending legs for receiving the first and second arms, respectively, of the gasket. In use, the coupling system facilitates faster
(Continued)

and easier manufacturability and assembly as compared to other known systems thus providing a more cost-effective solution, particularly when used with smaller tiles.

17 Claims, 10 Drawing Sheets

(58) Field of Classification Search
USPC ..... 52/715
See application file for complete search history.

(56) References Cited

U.S. PATENT DOCUMENTS

| | | | | |
|---|---|---|---|---|
| 4,134,244 | A | 1/1979 | Sjolander | |
| 4,987,712 | A | 1/1991 | Mancuso | |
| 5,029,425 | A | 7/1991 | Bogataj | |
| 5,263,292 | A * | 11/1993 | Holland | E04F 13/0826 52/235 |
| 5,390,457 | A | 2/1995 | Sjolander | |
| 5,860,257 | A | 1/1999 | Gerhaher et al. | |
| 6,055,787 | A | 5/2000 | Gerhaher et al. | |
| 6,138,423 | A | 10/2000 | Poutanen et al. | |
| 6,279,286 | B1 * | 8/2001 | Ichihashi | E04F 13/0826 52/489.1 |
| 6,289,647 | B1 * | 9/2001 | Sjolander | E04F 13/0803 52/510 |
| 6,418,689 | B1 | 7/2002 | Hacquard et al. | |
| 6,655,099 | B1 | 12/2003 | Trenoweth | |
| 6,725,618 | B2 | 4/2004 | Albracht | |
| 7,043,884 | B2 | 5/2006 | Moreno | |
| 7,644,549 | B2 | 1/2010 | Speck | |
| 7,827,746 | B2 | 11/2010 | Speck | |
| 8,096,091 | B2 | 1/2012 | Cristina | |
| 8,146,303 | B2 | 4/2012 | Gibson et al. | |
| 8,234,983 | B2 | 8/2012 | Randolph | |
| 8,381,475 | B2 | 2/2013 | Carbines | |
| 8,567,140 | B2 | 10/2013 | Wagner | |
| 8,763,336 | B2 | 7/2014 | Gulbrandsen et al. | |
| 8,769,901 | B2 | 7/2014 | Todd et al. | |
| 8,991,127 | B2 | 3/2015 | Todd et al. | |
| 9,016,020 | B1 | 4/2015 | Yang | |
| 9,085,908 | B2 | 7/2015 | Deschenes | |
| 9,091,078 | B2 | 7/2015 | Deschenes | |
| 9,109,368 | B2 | 8/2015 | MacKenzie | |
| 9,297,166 | B2 | 3/2016 | Carbines | |
| 9,410,566 | B2 | 8/2016 | Kikuchi et al. | |
| 9,551,510 | B2 | 1/2017 | Hartelius et al. | |
| 10,190,321 | B2 | 1/2019 | Li et al. | |
| 10,920,427 | B2 * | 2/2021 | Girnghuber | E04F 13/0826 |
| 11,156,005 | B2 * | 10/2021 | Schneider | E04B 1/003 |
| 2004/0010998 | A1 | 1/2004 | Turco | |
| 2006/0213142 | A1 | 9/2006 | Albracht | |
| 2007/0056238 | A1 | 3/2007 | Albracht | |
| 2009/0241459 | A1 | 10/2009 | Bryan | |
| 2010/0192495 | A1 | 8/2010 | Huff et al. | |
| 2012/0272604 | A1 | 11/2012 | Carbines | |
| 2014/0311064 | A1 | 10/2014 | Beaty et al. | |
| 2015/0225962 | A1 * | 8/2015 | Hancock | E04F 13/18 52/745.1 |
| 2015/0240490 | A1 | 8/2015 | Firinga | |
| 2017/0107724 | A1 | 4/2017 | Li et al. | |
| 2018/0320384 | A1 | 11/2018 | Pinnegar | |

FOREIGN PATENT DOCUMENTS

| | | | |
|---|---|---|---|
| DE | 202016106511 | U1 | 12/2016 |
| DE | 102017108590 | A1 | 10/2018 |
| EP | 0329060 | A2 | 8/1989 |
| EP | 1647649 | A2 | 4/2006 |
| EP | 2354367 | A2 | 8/2011 |
| FR | 2764917 | A1 | 12/1998 |
| GB | 2384501 | A | 7/2003 |
| JP | 2004044156 | A | 2/2004 |
| WO | 9410404 | A1 | 5/1994 |

OTHER PUBLICATIONS

Author Unknown., "Rainscreen Support System" NBK—Architectural Terracotta, retrieved Dec. 19, 2019. URL: https://nbkterracotta.com/en-us/products-services/substructure/terrart-substructure/.

Author Unknown, "Terreal-Terracotta Facade System" HVG Facades, retrieved Dec. 19, 2019. URL: https://hvgfacades.com.au/product/terreal/#tech-installation.

Author Unknown, "Tile Cladding"'231BEG1/Cladding system, published Oct. 10, 2012. URL: http://231beg1.blogspot.com/2012/10/tile-cladding.html#!/2012/10/tile-cladding.html.

Author Unknown, "Alternative Substructure" NBK—Architectural Terracotta—retrieved Dec. 19, 2018. URL: https://nbkterracotta.com/products-services/substructure/alternative-substructure/.

Author Unknown, "Argeton Terracotta cladding"—Taylor Maxwell—retrieved Dec. 19, 2018. URL: https://www.taylormaxwell.co.uk/facade-systems/terracotta-cladding.

Author Unknown, "Panel Installation Guide"—Nea Cera—retrieved Oct. 19, 2016.

Author Unknown, "Terrart—Terracotta Façades"—NBK—Architectural Terracotta—Dec. 8, 2015.

Author Unknown, "NeXclad 14™ Shingle"—Terreal—North America—retrieved Dec. 19, 2018. URL: http://www.terreal.us/products/nexclad/nexclad-shingle/#overview.

Author Unknown, "Precision Metal Stamping" Roller Die + Forming—retrieved Dec. 20, 2018. URL: https://www.rollerdie.com/stamping/.

Author Unknown, "Aluminum Terracotta Fixing System Tile Clips" LOPO Terracotta Products Corporation Limited, Dec. 19, 2018. URL: https://www.terracottapanel.com/aluminum-terracotta-fixing-system-tile-clips_p242.html.

Author Unknown, "Support System for Architectural Terracitta (Ceramic) Façades Tiles" NBK USA—retrieved Dec. 13, 2018.

Author Unknown, NBM® Terrart Solid Precast System NBK Terrart™—2015 Hunter Douglas.

International Search Report and Written Opinion for International application No. PCT/US2020/028196, dated Aug. 6, 2020, 14 pages.

* cited by examiner

COUPLING SYSTEM FOR MOUNTING TILES TO A BUILDING

CROSS-REFERENCE TO RELATED APPLICATIONS

This application is a National Phase filing of International Application No. PCT/US2020/028196, filed Apr. 15, 2020, which is a non-provisional of, and claims the benefit of the filing date of, U.S. provisional patent application No. 62/840,482, filed Apr. 30, 2019, entitled "Coupling System for Mounting Tiles to a Building," each application is incorporated by reference herein in its entirety.

SUMMARY OF THE INVENTION

The present disclosure is directed to a coupling system for mounting a tile or façade or other functional or aesthetic structure to a building.

BACKGROUND

Generally speaking, exterior tiles may be coupled, mounted, attached, secured, or the like (used interchangeably herein without the intent to limit) to the framework of a building. For example, exterior facades, tiles, or other structural or decorative features, etc. such as, for example, ceramics, terracotta, or the like (collectively referred to herein as tiles without the intent to limit), may be coupled to the exterior framework of a building for any of a variety of architectural reasons. In use, the tile may have any size and/or shape, and may be manufactured from any type of material.

There are a number of known systems in the marketplace for coupling tiles to a building. Generally speaking, however, they suffer from a number of disadvantages. For example, when using smaller sized tiles, the economics of using individual clips for each tile may become cost prohibitive. In addition, many current systems utilize a clip to engage a groove formed in a rear surface of the tile. However, engaging a groove formed in the rear surface of the tile may be undesirable since the tile may become damaged during installation but such damage may not be detected. Furthermore, current systems do not facilitate and/or permit replacement of individual tiles. Thus, replacement of damaged tiles is rendered labor intensive and time-consuming.

There is a need for an improved coupling system for mounting exterior tiles to a building. For example, it would be beneficial to provide a coupling system that is cheaper to manufacture and assemble to make using smaller tiles more cost effective. Additionally, and/or alternatively, it would be beneficial to provide a coupling system that minimizes the risk of damaging the grooves formed in the rear surface of the tiles during installation, which reduces the risk that one or more tiles may fall from the building. Additionally, and/or alternatively, it would be beneficial to provide a coupling system that facilitates easier and individual replacement of each tile, and which allows for a non-progressive installation process. It is with this in mind that the present disclosure is provided.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is a coupling system arranged and configured to mount a tile to a support structure (e.g., an outer surface) of a building. The coupling system includes one or more support tracks arranged and configured to mount or couple the tile to the building. The support tracks may be coupled, directly or indirectly, to the building via, for example, one or more fasteners. In use, the support tracks may extend vertically along the support structure of the building, and may be spaced horizontally therealong.

In use, the support tracks include a plurality of clips arranged and configured to couple with the tiles. In one example of an embodiment, the clips and support track may be integrally formed. That is, for example, the clips may be punched and formed (e.g., bent) from material of the support tracks.

The clips may include a first, downwardly extending channel arranged and configured to couple, receive, etc. to a top edge portion of a lower tile and a second, upwardly extending channel arranged and configured to couple, receive, etc. to a bottom edge portion of an upper tile.

In one example of an embodiment, the coupling system may also include a seal or gasket. The seal or gasket may be coupled to the support tracks. In use, the seal or gasket prevents, or at least inhibits, water from entering into the system through joints between tiles. In addition, the seal or gasket may be arranged and configured to assist with holding the tiles against the clips to prevent the tiles from shifting and/or disengaging. In one example of an embodiment, the seal or gasket may include first and second arms. The support tracks may include first and second inwardly extending legs arranged and configured to receive the first and second arms, respectively, of the seal or gasket. In one embodiment, the first and second legs may be integrally formed with the support tracks. That is, for example, the first and second legs may be punched and formed from material of the support tracks.

In use, the coupling system facilitates faster and easier manufacturability and assembly as compared to other known systems thus providing a more cost-effective solution, particularly when used with smaller tiles. In addition, the coupling system enables individual replacement of each tile. Moreover, the coupling system reduces the risk of damaging the tiles during installation and enables the system to withstand increased wind loads.

In one example of an embodiment, a coupling system arranged and configured to couple a plurality of tiles to a building is disclosed. The coupling system comprises a plurality of support tracks arranged and configured to be coupled to the building, said support tracks including a base, first and second sidewalls extending from said base, and first and second flanges extending from said first and second sidewalls, respectively, and spaced from said base, wherein each of said first and second flanges of said support tracks includes a plurality of clips arranged and configured to couple with the tiles, each of the plurality of clips is integrally formed with said first and second flanges of said support tracks, and each of said plurality of clips includes a first, downwardly extending channel arranged and configured to couple to a top edge portion of a lower tile and a second, upwardly extending channel arranged and configured to couple to a bottom edge portion of an upper tile.

In one example of an embodiment, a coupling system arranged and configured to couple a plurality of tiles to a building is disclosed. The coupling system comprises a plurality of support tracks arranged and configured to couple to the building, said support tracks including a base, first and second sidewalls extending from said base, and first and second flanges extending from said first and second sidewalls, respectively, and spaced from said base, a plurality of clips arranged and configured to couple with the tiles, said plurality of clips being operatively associated with each of said first and second flanges of said support tracks, and a gasket arranged and configured to couple to said support tracks, wherein said first and second sidewalls of said support tracks include first and second inwardly extending legs, respectively, arranged and configured to couple to said gasket, and said first and second inwardly extending legs are integrally formed with said support tracks.

In one example of an embodiment, a system arranged and configured to couple a plurality of tiles to a building is disclosed. The system comprises a plurality of tiles including an upper tile and a lower tile, each tile including a top edge portion and a bottom edge portion, and a plurality of support tracks arranged and configured to be coupled to the building, said support tracks including a base, first and second sidewalls extending from said base, and first and second flanges extending from said first and second sidewalls, respectively, wherein each of said first and second flanges of said support tracks includes a plurality of clips arranged and configured to couple with one of the plurality of tiles, each of the plurality of clips is integrally formed with said first and second flanges of said support tracks, and each of said plurality of clips include a first, downwardly extending channel arranged and configured to hold said top edge portion of said lower tile and a second, upwardly extending channel arranged and configured to hold said bottom edge portion of said upper tile.

In one example of an embodiment, a method for coupling a plurality of tiles to a building is disclosed. The method comprises coupling a plurality of support tracks to a support structure of the building, said plurality of support tracks being spaced horizontally across a width of the building, coupling a gasket to each of said plurality of support tracks, slidably inserting a top edge portion of a first tile into a first, downwardly extending channel formed on said support tracks, slidably inserting a bottom edge portion of said first tile into a second, upwardly extending channel on said support tracks, and repeating inserting said plurality of tiles as necessary.

DETAILED DESCRIPTION

Figure 1:
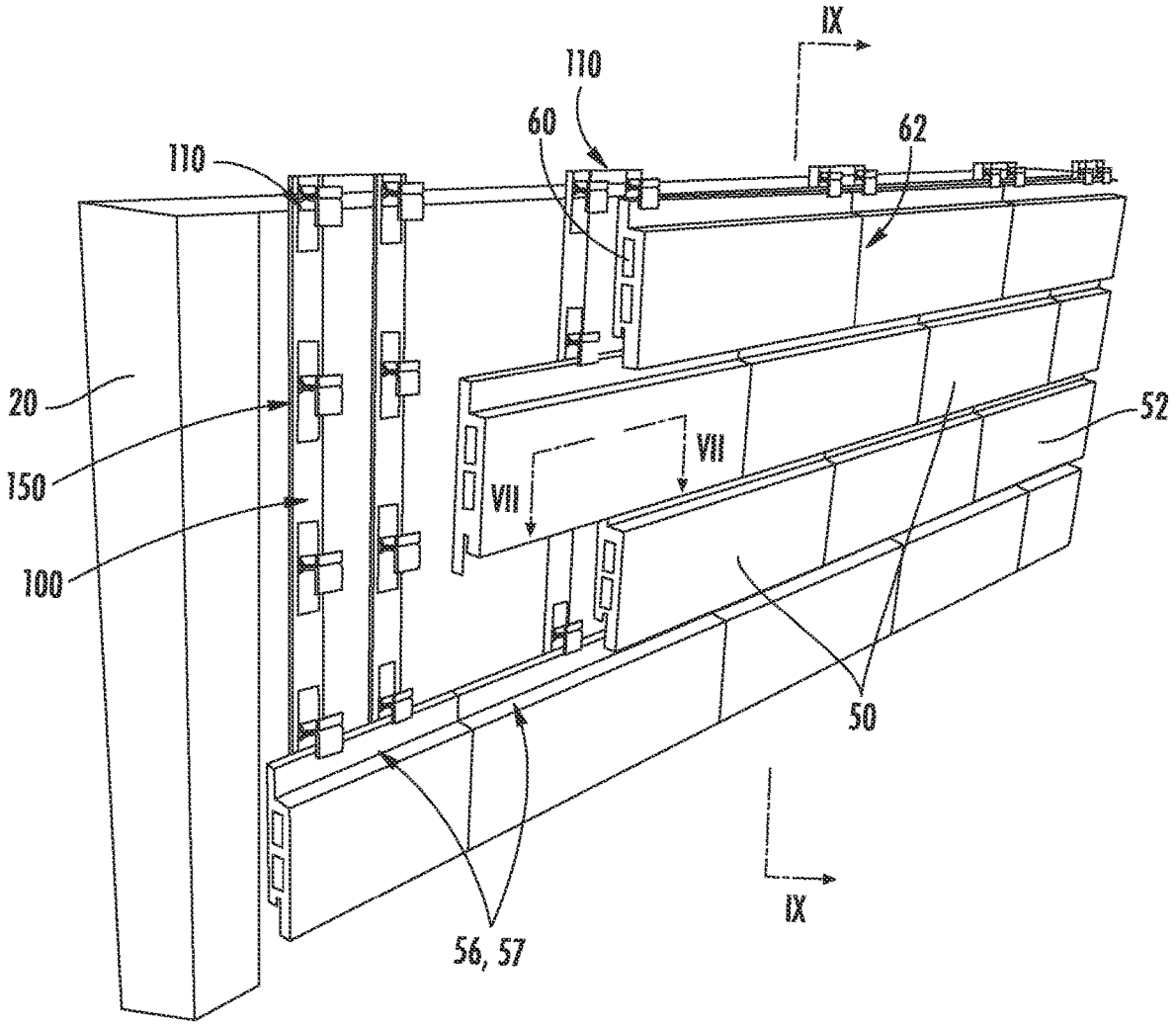
FIG. 1 is a partial, perspective view illustrating a coupling system for coupling a plurality of tiles to a support structure of a building embodying examples of one or more aspects of the present disclosure.

Various features, aspects, or the like of a coupling system for mounting a tile such as, for example, an exterior tile, to a building will now be described more fully hereinafter with reference to the accompanying drawings, in which one or more aspects of the coupling system will be shown and described. It should be appreciated that the various features, aspects, or the like may be used independently of, or in combination, with each other. It will be appreciated that a coupling system as disclosed herein may be embodied in many different forms and should not be construed as being limited to the embodiments set forth herein. Rather, these embodiments are provided so that this disclosure will convey certain aspects of the coupling system to those skilled in the art. In the drawings, like numbers refer to like elements throughout unless otherwise noted.

Disclosed herein is a coupling system for mounting, coupling, etc. a plurality of tiles to a support structure (e.g., an outer surface, a sub-girt, or the like) of a building. The coupling system includes a plurality of support tracks arranged and configured to mount or couple the tile to the building. The support tracks may be coupled, directly or indirectly, to the support structure of the building via, for example, one or more fasteners. In use, the support tracks may extend vertically along the support structure of the building, and may be spaced horizontally therealong.

In use, the support tracks may include a base, first and second sidewalls extending from the base, and first and second flanges extending from the first and second sidewalls, respectively. In addition, the first and second flanges may be spaced from the base (e.g., may be spaced from the base by a distance in a direction perpendicular to a plane of the base to create an air gap between a rear surface of the tile and the support structure of the building so that air may flow or move between the tile and the support structure of the building). The support tracks also include a plurality of clips arranged and configured to couple the tiles to the support tracks, and hence to the building. That is, for example, each of the first and second flanges of the support tracks may include a plurality of clips arranged and configured to couple with or receive (used interchangeably herein without the intent to limit) the tiles. The clips and support track may be integrally formed. For example, the clips may be punched and formed (e.g., bent) from material used to manufacture the support tracks such as, for example, the first and second flanges. The clips may include a first, downwardly extending channel arranged and configured to couple to, receive, etc. a top edge portion of a lower tile and a second, upwardly extending channel arranged and configured to couple to, receive, etc. a bottom edge portion of an upper tile.

Additionally, the coupling system may also include a seal or gasket. In use, the seal or gasket prevents, or at least inhibits, water from entering into the system through joints between tiles. In addition, the seal or gasket may be arranged and configured to apply outward pressure against the tiles thereby pressing the tiles against the clips to prevent the tiles from shifting and/or disengaging. The seal or gasket may be coupled to the support tracks. For example, the support tracks may include first and second legs arranged and configured to couple to, receive, etc. a portion of the seal or gasket. The first and second legs may be integrally formed with the support tracks. For example, the first and second legs may be punched and formed from material used to manufacture the support tracks such as, for example, the first and second sidewalls of said support tracks.

Thus, arranged, the coupling system facilitates faster and easier manufacturability and assembly as compared to other known systems thus providing a more cost-effective solution, particularly when used with smaller tiles. In addition, the coupling system enables individual replacement of each tile. Moreover, the coupling system reduces the risk of damaging the tiles during installation and enables the system to withstand increased wind loads.

A coupling system arranged and configured to couple a plurality of tiles to a building is disclosed herein. In one embodiment, the coupling system comprises a plurality of support tracks arranged and configured to be coupled to the building, the support tracks including a base, first and second sidewalls extending from the base, and first and second flanges extending from the first and second sidewalls, respectively, and spaced from the base. Each of the first and second flanges of the support tracks includes a plurality of clips arranged and configured to couple with the tiles. Each of the plurality of clips is integrally formed with the first and second flanges of the support tracks. Each of the plurality of clips include a first, downwardly extending channel arranged and configured to couple to a top edge portion of a lower tile and a second, upwardly extending channel arranged and configured to couple to a bottom edge portion of an upper tile.

In another embodiment, a coupling system arranged and configured to couple a plurality of tiles to a building comprises a plurality of support tracks arranged and configured to couple to the building, the support tracks including a base, first and second sidewalls extending from the base, and first and second flanges extending from the first and second sidewalls, respectively, and spaced from the base. The coupling system further comprising a plurality of clips arranged and configured to couple with the tiles, the plurality of clips being operatively associated with each of the first and second flanges of the support tracks; and a gasket arranged and configured to couple to the support tracks. The first and second sidewalls of the support tracks include first and second inwardly extending legs, respectively, arranged and configured to couple to the gasket. The first and second legs are integrally formed with the support track.

A system arranged and configured to couple a plurality of tiles to a building is also disclosed. In one embodiment, the system comprises a plurality of tiles including an upper tile and a lower tile, each tile including a top edge portion and a bottom edge portion; and a plurality of support tracks arranged and configured to be coupled to the building, the support tracks including a base, first and second sidewalls extending from the base, and first and second flanges extending from the first and second sidewalls, respectively. Each of the first and second flanges of the support tracks includes a plurality of clips arranged and configured to couple with one of the plurality of tiles. Each of the plurality of clips is integrally formed with the first and second flanges of the support tracks. Each of the plurality of clips include a first, downwardly extending channel arranged and configured to hold the top edge portion of the lower tile and a second, upwardly extending channel arranged and configured to hold the bottom edge portion of the upper tile.

A method for coupling a plurality of tiles to a building is also disclosed. In one embodiment, the method comprises: coupling a plurality of support tracks to a support structure of the building, the plurality of support tracks being spaced horizontally across a width of the building; coupling a gasket to each of the plurality of support tracks; slidably inserting a top edge portion of a first tile into a first, downwardly extending channel formed on the support tracks; slidably inserting a bottom edge portion of the first tile into a second, upwardly extending channel on the support track; and repeating insertion of the plurality of tiles as necessary.

Figure 2:
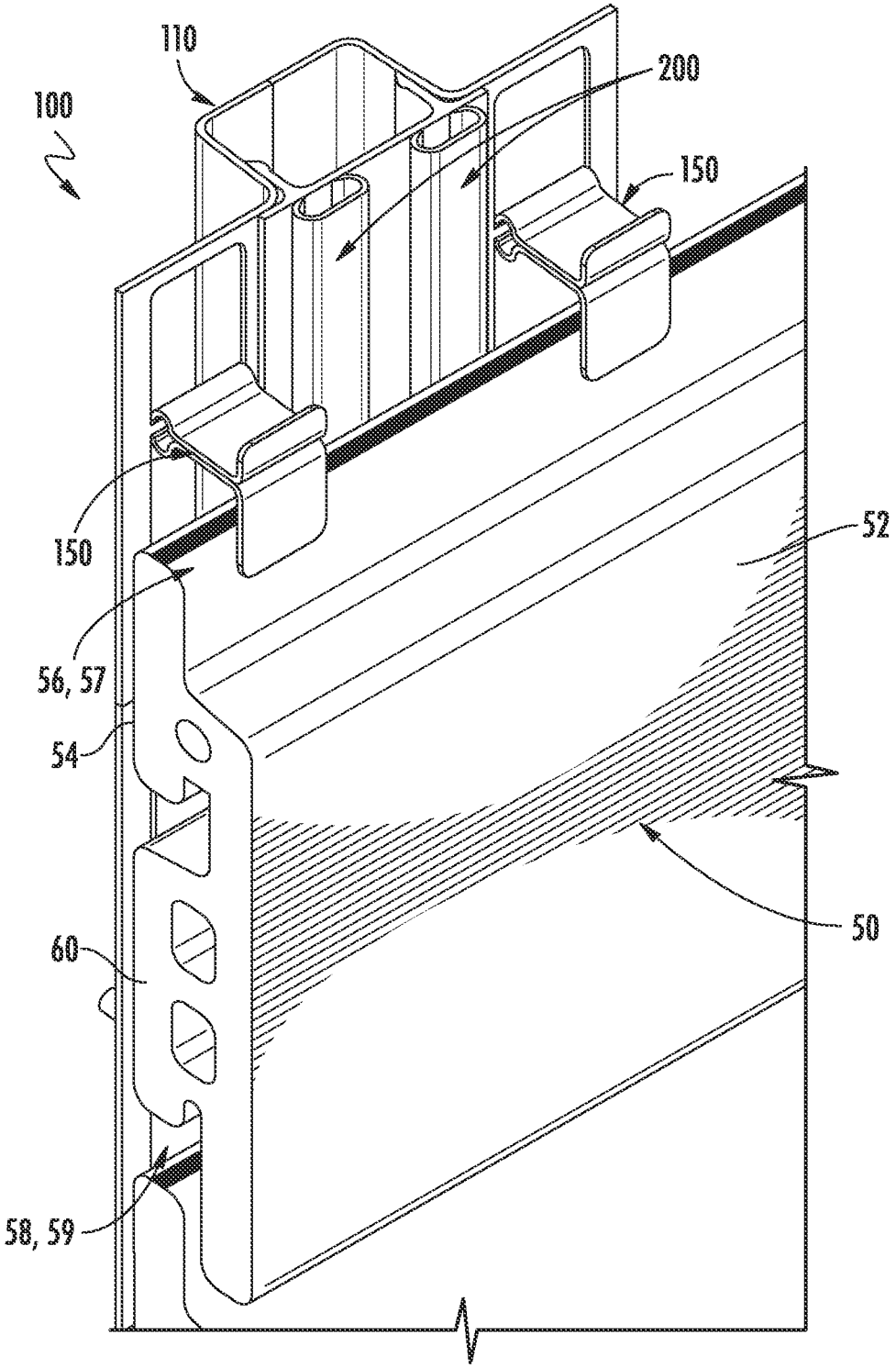
FIG. 2 is a front, detailed perspective view illustrating the coupling system shown in FIG. 1 coupled to a tile.
Figure 3:
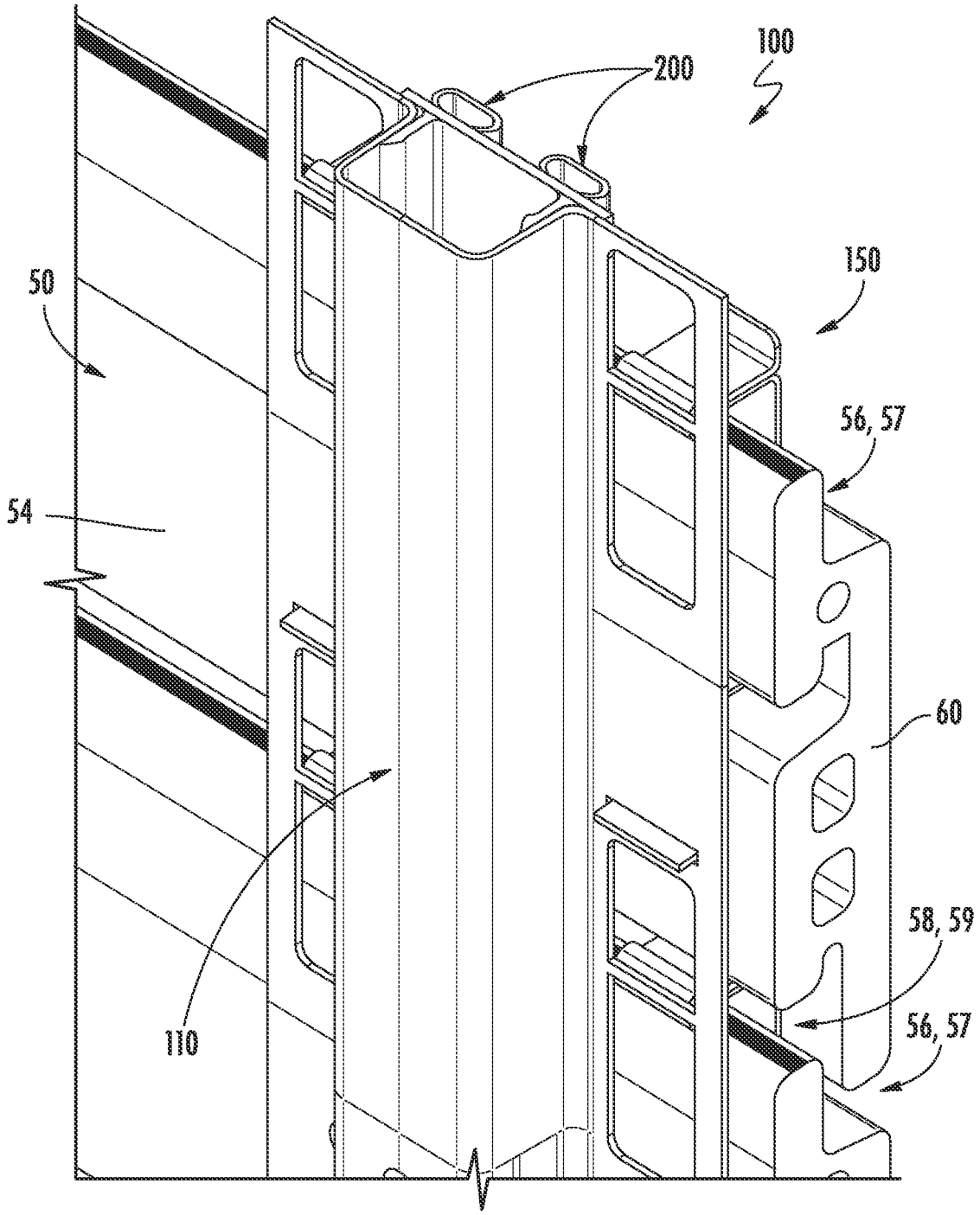
FIG. 3 is a rear, detailed perspective view illustrating the coupling system shown in FIG. 1 coupled to a tile.

Generally speaking, referring to FIGS. 1-3, and as will be appreciated by one of ordinary skill in the art, a building includes a support structure or framework 20 (FIG. 1) such as, for example, a sub-girt rail system, columns, supports, an outer wall or surface such as, for example, wood and metal stud walls, a concrete wall, etc. (collectively herein support structure without the intent to limit). For one or more reasons, tiles 50 (e.g., exterior tiles) may be coupled to the support structure 20 of the building. For example, exterior facades, tiles, or other structural or decorative features, etc. such as, for example, ceramics, terracotta, or the like (collectively referred to herein as tiles without the intent to limit), are coupled to an exterior support structure 20 of the building. As shown, in one example of an embodiment, the tiles 50 may have a rectangular shape including a front surface 52 that forms the façade of the building, a rear surface 54 opposite the front surface 52, a top edge portion 56, a bottom edge portion 58, and first and second side edge portions 60, 62. The top edge portion 56 may include a recessed surface 57, and the bottom edge portion 58 may include a recess or groove 59 for coupling to first and second clips 150 for coupling the tiles 50 to support tracks 110, as will be described in greater detail. The tiles 50 may, however, have any size and/or shape which can be used with the disclosed coupling system, and may be manufactured from any type of material.

An improved coupling system 100 for coupling, mounting, attaching, securing, or the like (used interchangeably herein without the intent to limit) a tile 50 to a support structure 20 of a building in accordance with one aspect of the present disclosure is illustrated in FIGS. 1-4. As illustrated, the coupling system 100 includes one or more support tracks 110 arranged and configured to couple the tile 50 to the support structure 20 of the building. The support tracks 110 are coupled, directly or indirectly, to the support structure 20 of the building by any now known or hereafter developed mechanism including, for example, fasteners, adhesive, etc. In use, the support tracks 110 may extend vertically along the support structure 20 of the building, and may be spaced horizontally therealong. The support tracks 110 may extend an entire height of the building, or only a portion thereof. In one example of an embodiment, depending on the size and shape of the tiles 50 being used, the support tracks 110 may be spaced approximately 32 inches (e.g. 81 centimeters), although other configurations and spacings are envisioned. In use, the support tracks 110 are horizontally spaced so that each tile 50 is coupled to at least two support tracks 110, one on either end of the tile. As such, as will be appreciated by one of ordinary skill in the art, the spacing of the support tracks 110 will be largely dependent on the tile 50 being used (e.g., the spacing of the support tracks 110 is based on the size of the tile 50 used, which in one example may be 32 inches).

Figure 4:
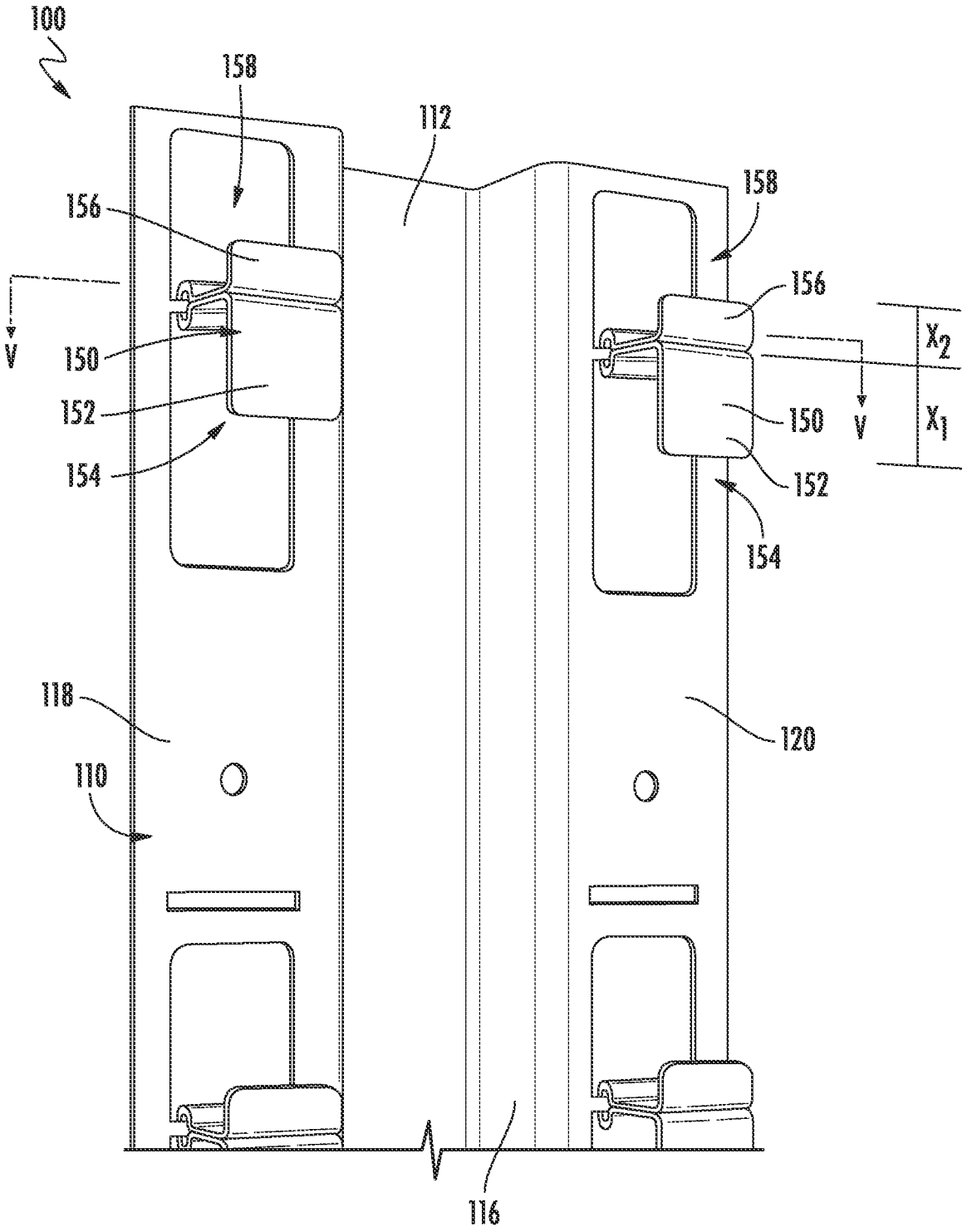
FIG. 4 is a front, partial perspective view illustrating an example of a support track that may be used with the coupling system shown in FIG. 1, the support track including integrally formed clips.
Figure 5:
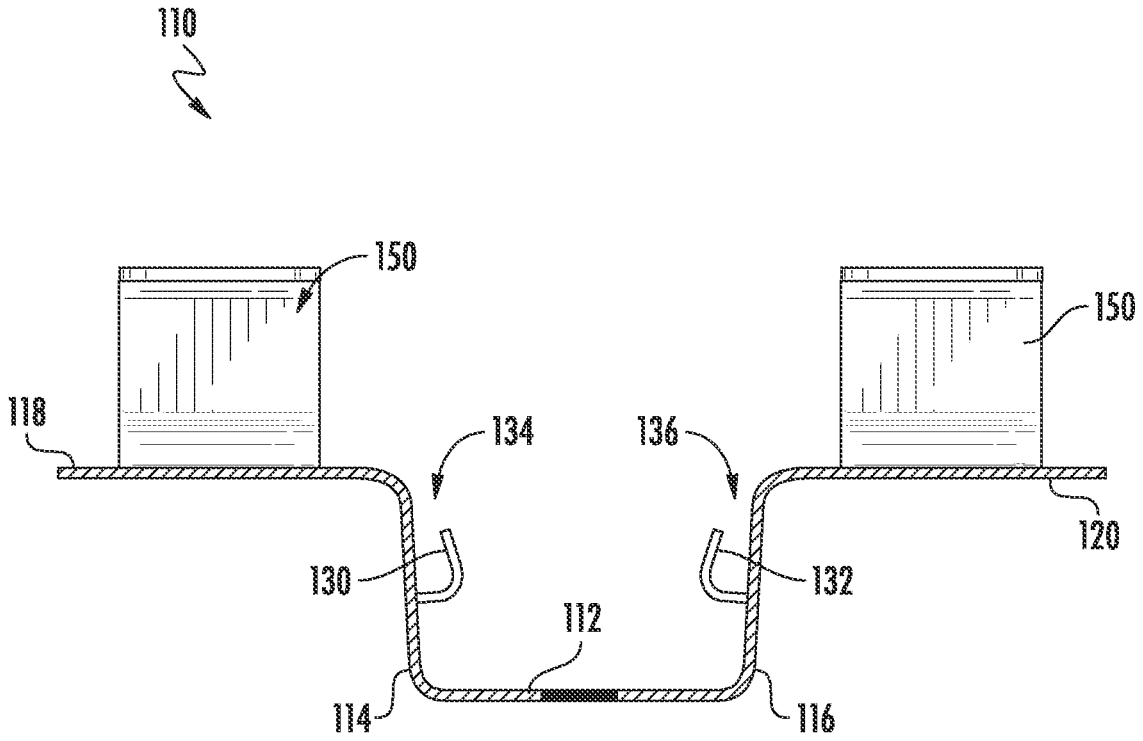
FIG. 5 is a cross-sectional view along line V-V in FIG. 4 of the support track shown in FIG. 2.
Figure 6:
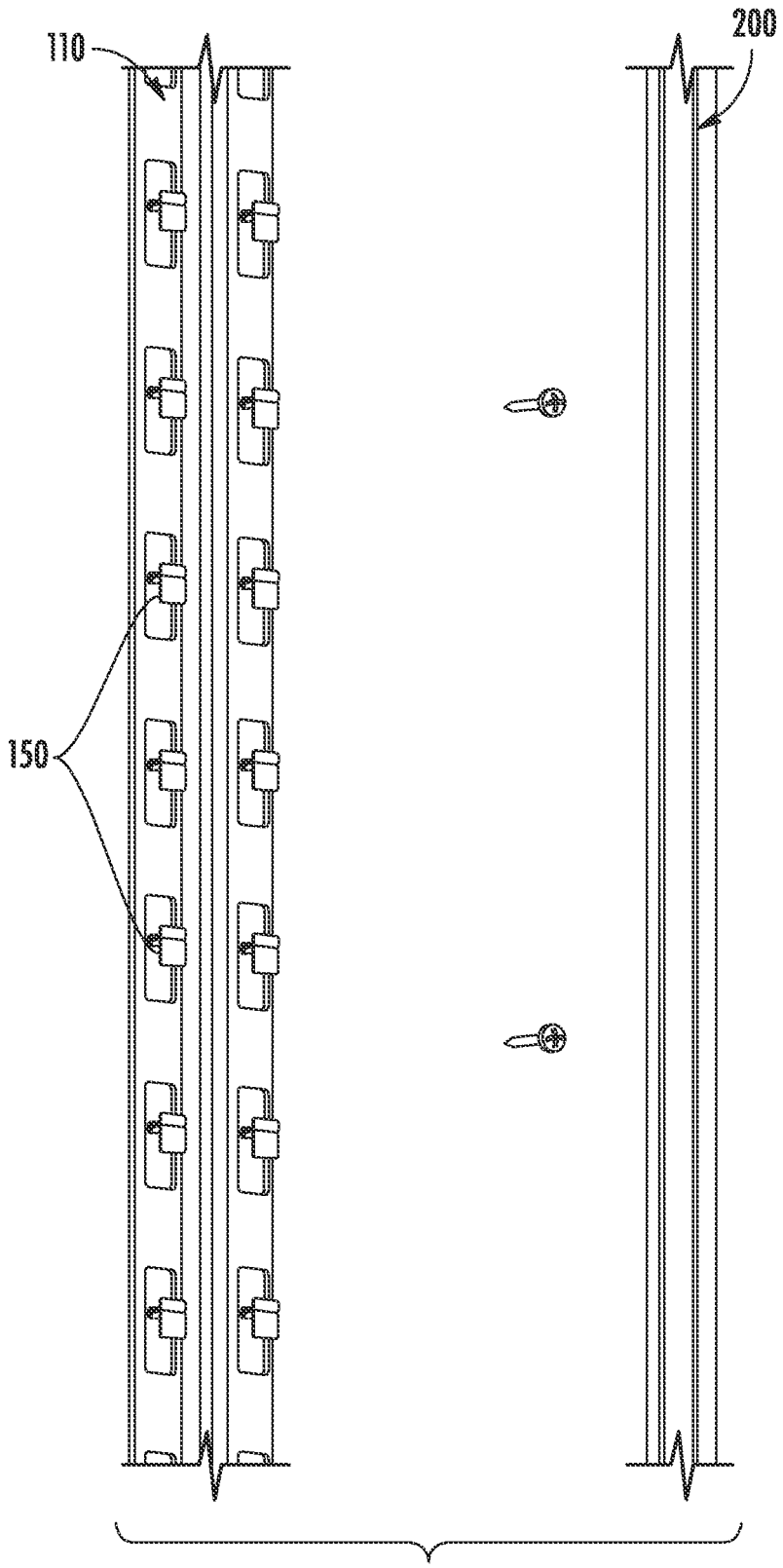
FIG. 6 is a front, partial, exploded perspective view illustrating the coupling system shown in FIG. 1, the coupling system including the support track shown in FIGS. 4 and 5, and an example of an embodiment of a gasket that may be used therewith.

As illustrated in FIGS. 4 and 5, the support track 110 may include a base 112, first and second sidewalls 114, 116 extending from the base 112 on either side thereof, and first and second flanges 118, 120 extending from the first and second sidewalls 114, 116, respectively. In addition, the first and second flanges 118, 120 may be spaced from the base 112 by a distance in a direction perpendicular to a plane of the base 112. Thus arranged, the support track 110 may be characterized as having a generally U-shaped cross-sectional profile with flanges extending therefrom and spaced from the base 112, although other shapes and configurations are envisioned. The base 112 of the support tracks 110 may include holes (e.g., punched holes) enabling fastening of the support tracks 110 to the support structure 20 of the building.

The support tracks 110 including the base 112, first and second sidewalls 114, 116, and the first and second flanges 118, 120 may be made from any suitable material now known or hereafter developed including, for example, metal such as, for example, steel or stainless steel. The support tracks 110 including the base 112, first and second sidewalls 114, 116, and the first and second flanges 118, 120 may be integrally formed (e.g., rolled and pressed into shape). Alternatively, however, the support tracks 110 including the base 112, first and second sidewalls 114, 116, and the first and second flanges 118, 120 may be made from separate components and coupled together via, for example, welding, adhesive, etc. As will be appreciated by one of ordinary skill in the art, various features of the support tracks 110 may be readily modified depending on the size and configuration of the tiles 50 being utilized, such modifications being within the scope of the present disclosure.

The support tracks 110 may be operatively associated with a plurality of clips 150 for mounting the tiles 50 to the support track 110, and hence to the building. For example, as illustrated in FIGS. 4 and 5, the clips 150 may be operatively associated with the first and second flanges 118, 120 of the support tracks 110. As illustrated in FIG. 4, in one example of an embodiment, the clips 150 may include a first, downwardly extending arm 152 spaced from a surface of the first and second flanges 118, 120 so that the downwardly extending arm 152 defines a downwardly extending channel 154 for receiving, holding, etc. the top edge portion 56 of the tile 50 (e.g., the downwardly extending channel 154 being arranged and configured to receive the recessed surface 57, if provided, formed on the top edge portion 56 of the tile 50) and a second, upwardly extending arm 156 spaced from a surface of the first and second flanges 118, 120 so that the downwardly extending arm 152 defines an upwardly extending channel 158 for receiving, holding, etc. the bottom edge portion 58 of the tile 50 (e.g., the upwardly extending channel 158 being arranged and configured to receive the recess or groove 59, if provided, formed in the bottom edge portion 58 of the tile 50). As illustrated in FIGS. 1-3 and 9, the tiles 50 and clips 150 are arranged and configured so that the bottom edge portion 58 of an upper tile overlaps with the top edge portion 56 of a lower tile to prevent, or at least inhibit, visibility of the coupling system 100 through the joints between tiles 50.

As illustrated in FIG. 4, in one example of an embodiment, the first, downwardly extending channel 154 may include a recess having a depth extending a first distance $X_1$ while the second, upwardly extending channel 158 may include a recess having a depth extending a second distance $X_2$ less than the first distance $X_1$. In this manner, the first, downwardly extending channel 154 provides increased spacing for enabling the top edge portion 56 of the tile 50 to move therein during installation, as will be described in greater detail below.

As illustrated, in one example of an embodiment, the clips 150 including the first, downwardly extending arm 152 and the second, upwardly extending arm 156, may be integrally formed with the support tracks 110. That is, for example, the clips 150 may be punched and formed (e.g., bent) from material of the first and second flanges 118, 120 of the support tracks 110. By integrally forming the clips 150 and the support tracks 110, the square foot/meter cost of the coupling system 100 is greatly reduced as compared to using separately formed and coupled clips, especially when utilizing smaller sized tiles (e.g., 4-inch, 6-inch, etc. tiles). If necessary, the clips 150 can be spot welded for higher stability and lower tolerances. Alternatively, however, it is envisioned that the clips 150 may be separately formed and coupled to the support tracks 110.

As will be appreciated by one of ordinary skill in the art, generally speaking, an air gap is required between the rear surface 54 of the tile 50 and the support structure 20 of the building so that air may flow or move between the tile 50 and the support structure 20 of the building. By forming the support tracks 110 with first and second sidewalls 114, 116 spaced from the base 112 of the support tracks 110, and by operatively coupling or integrally forming the clips 150 on the first and second flanges 118, 120 of the support tracks 110, the clips 150 are spaced from the support structure 20 of the building by the distance of the first and second sidewalls 114, 116, thus creating the required air gap between the tile 50 and the support structure 20 of the building. In one example, the gap is approximately ½ inches, although larger gaps are envisioned.

As will be described in greater detail below, the coupling system 100 may also include a gasket 200 (FIGS. 2, 3, and 6-8). In use, the gasket 200 may serve dual purposes. The gasket 200 may act to inhibit water from contacting the base 112 and the first and second sidewalls 114, 116 of the support tracks 110 thereby minimizing corrosion of the support tracks 110 (e.g., the gasket 200 prevents, or at least inhibits, water from entering into the system through joints). In addition, the gasket 200 fills space between the rear surface 54 of the tile 50 and the front surface of the first and second flanges 118, 120 of the support tracks 110 to eliminate unwanted shifting of the tiles 50 (e.g., the gasket 200 may be arranged and configured to apply outward pressure against the tiles 50 thereby pressing the tiles 50 against the clips 150 to prevent the tiles 50 from shifting relative to the support tracks 110 and/or disengaging from the support tracks 110).

Figure 7:
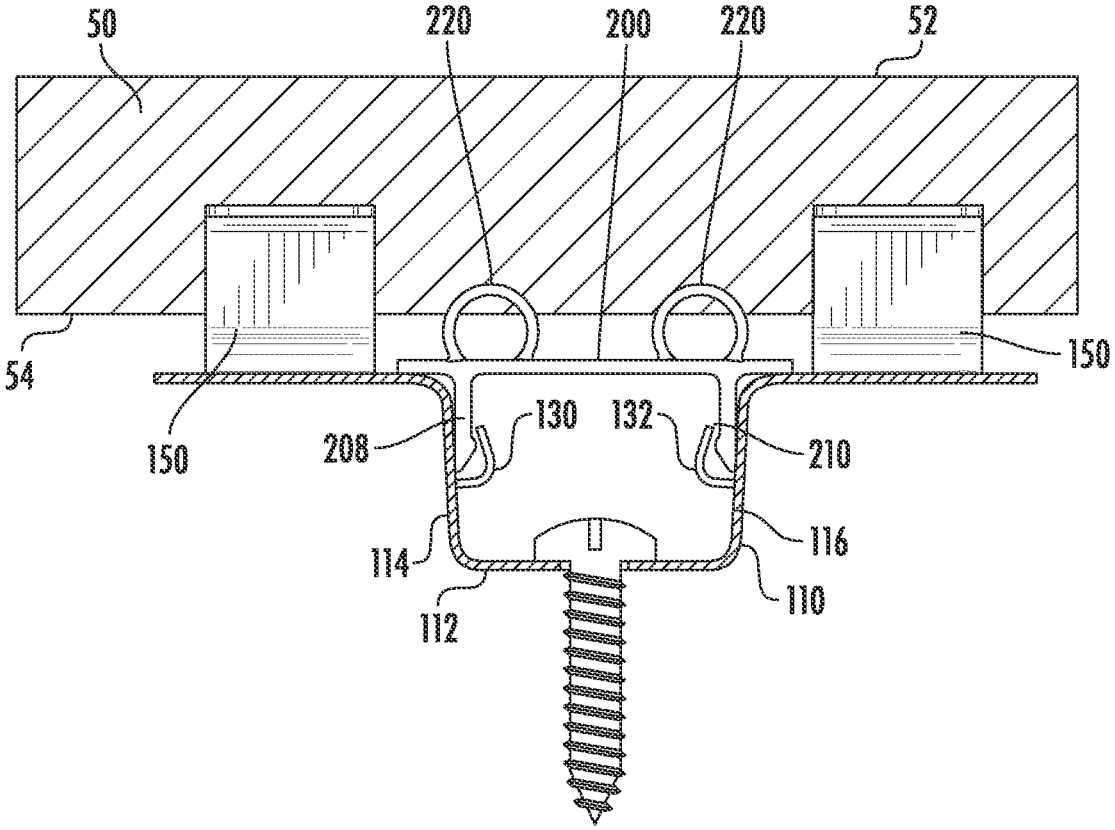
FIG. 7 is a horizontal, cross-sectional view along line VII-VII in FIG. 1 of the coupling system shown in FIG. 6 coupled to a tile.

As illustrated in FIGS. 2, 3, and 7, the gasket 200 may be coupled to the support tracks 110. In use, the gasket 200 may be coupled to the support tracks 110 by any suitable mechanism now known or hereafter developed. In one embodiment, the support tracks 110 may include first and second channels 134, 136 (FIG. 5) for receiving the gasket 200. For example, as illustrated in FIG. 5, the first and second sidewalls 114, 116 of the support track 110 may include first and second inwardly extending legs 130, 132, respectively (also referred to herein as first and second legs). In use, the first leg 130 defines the first channel 134 and the second leg 132 defines the second channel 136.

Figure 8:
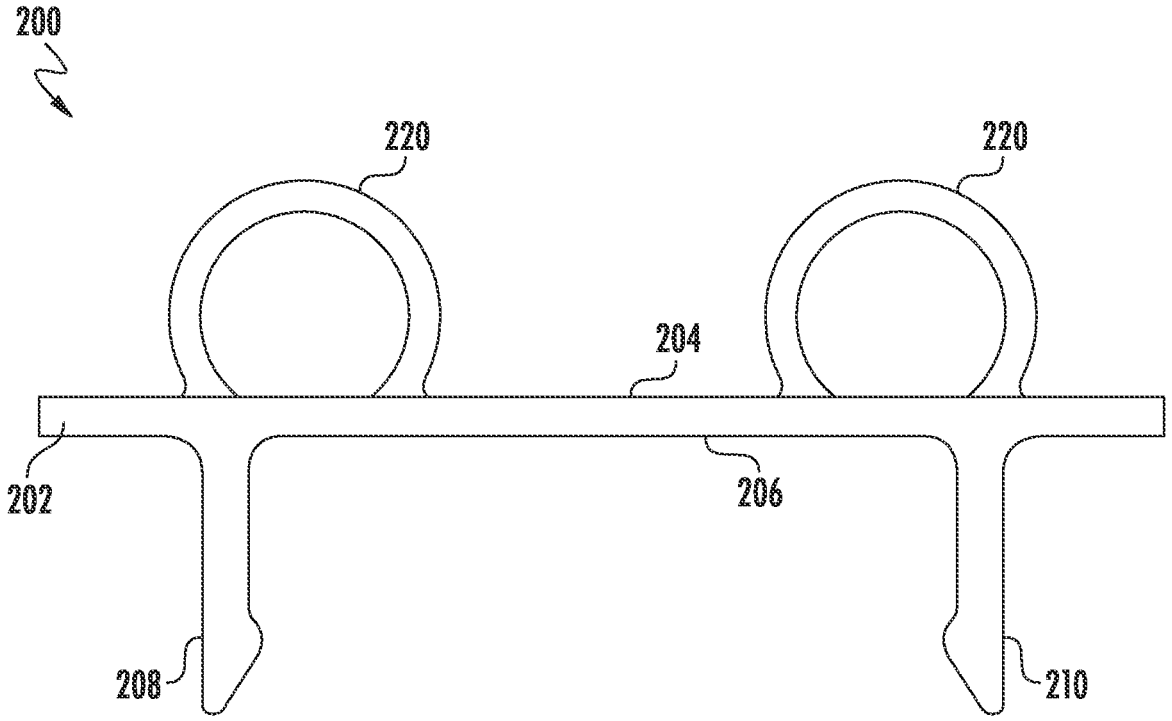
FIG. 8 is an end view illustrating the gasket shown in FIG. 6.
Figure 9:
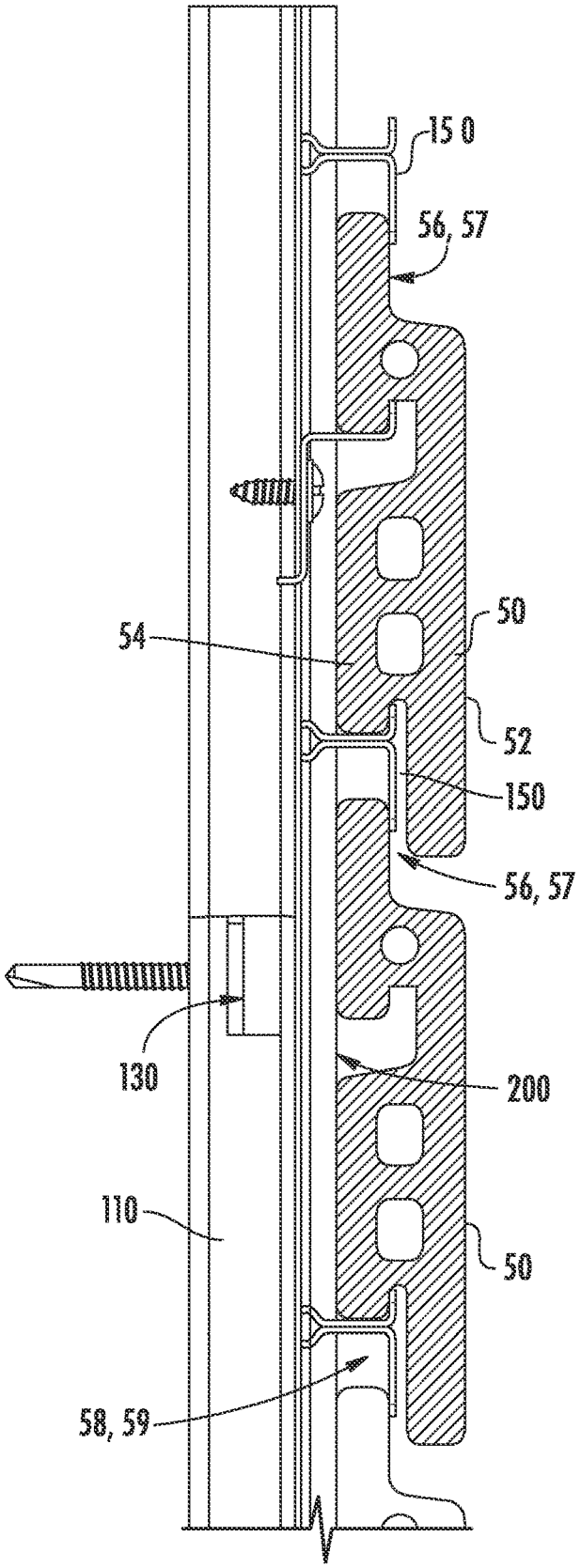
FIG. 9 is a longitudinal, cross-sectional view along line IX-IX in FIG. 1 of the coupling system shown in FIG. 6 coupled to a tile.

As illustrated in FIGS. 7 and 8, the gasket 200 may include a base 202 (FIG. 8) including a front surface 204 (FIG. 8) and a rear surface 206 (FIG. 8). The base 202 may further include first and second arms 208, 210 extending from the rear surface 206 of the base 202. In use, the first and second arms 208, 210 of the gasket 200 are arranged and configured to be coupled to the first and second channels 134, 136 defined by the first and second legs 130, 132 formed on the first and second sidewalls 114, 116 of the support track 110. That is, the first and second arms 208, 210 formed on the gasket 200 may be arranged and configured to be received by the first and second channels 134, 136 formed between the first and second legs 130, 132 of the support tracks 110 and the first and second sidewalls 114, 116 of the support tracks 110. In this manner, the gasket 200 may be snap-fitted to the support tracks 110, although other forms of coupling the gasket 200 to the support track 110 are envisioned including, for example, fasteners, adhesives, etc.

The first and second legs 130, 132 may be integrally formed with the support tracks 110. That is, for example, the first and second legs 130, 132 may be punched and formed from material of the first and second sidewalls 114, 116 of the support tracks 110. By integrally forming the first and second legs 130, 132 and support tracks 110, the cost per square foot/meter of the coupling system 100 is further reduced. Alternatively, however, it is envisioned that the first and second legs 130, 132 may be separately formed and coupled to the support tracks 110. In one example of an embodiment, the first and second legs 130, 132 may be spaced approximately every 12 inches (e.g., 30 centimeters) along the length of the support tracks 110, although other spacings are envisioned.

The gasket 200 may further include one or more sections 220 extending from the front surface 204 of the base 202 of the gasket 200. As shown, the one or more sections may be in the form of one or more bulbous sections, although it is envisioned that the sections 220 may take on other shapes, forms, and configurations such as, for example, square, rectangular, or the like. As illustrated, the gasket 200 may include first and second bulbous sections 220 extending from the front surface 204 of the gasket 200, although more or fewer bulbous sections may be used. In use, the bulbous sections 220 may be arranged and configured to compress during tile installation. Thereafter, the bulbous sections 220 may fill any remaining space between the front surface of the first and second flanges 118, 120 of the support tracks 110 and the rear surface 54 of the tile 50. Thus arranged, the gasket 200 (e.g., the bulbous sections 220) may apply outward pressure against the rear surface 54 of the tile 50 to push or hold the tile 50 forward against the clips 150 to prevent the tiles 50 from shifting and/or disengaging.

The gasket 200 may be manufactured from any suitable material now known or hereafter developed. In one example of an embodiment, the gasket 200 may be manufactured from a rubber, an elastomer, etc. In one embodiment, the bulbous sections 220 of the gasket 200 may be manufactured from a softer Shore A hardness as compared to the other parts of the gasket 200 to better enable the bulbous sections 220 to compress. For example, in one embodiment, the bulbous sections 220 may be manufactured from an elastomer having a Shore A hardness of approximately 50, while the Shore A hardness of the base 202 and the first and second arms 208, 210 may be manufactured from an elastomer having a Shore A hardness of approximately 80. The gasket 200 including the base 202, first and second arms 208, 210, and the bulbous sections 220 may be integrally formed. Alternatively, the gasket 200 may be manufactured from separate components and coupled together.

Figure 10:
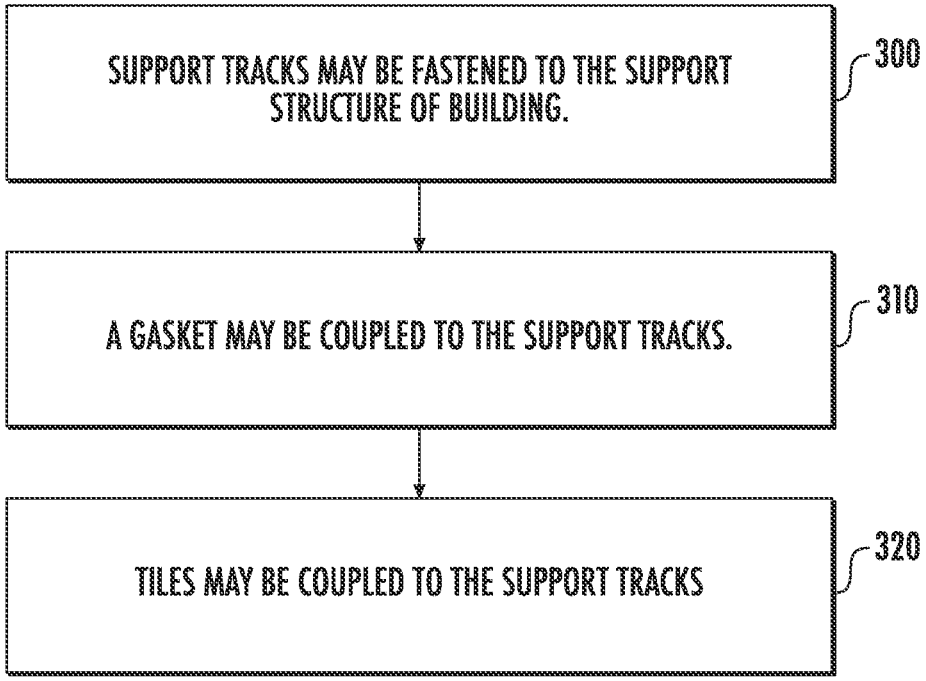
FIG. 10 is an illustrative example of an embodiment of a method of installing the tiles to the building in accordance with one or more aspects of the present disclosure.

In use, the coupling system 100 facilitates faster and easier assembly as compared to other known system. Referring to FIG. 10, in one example of a method of use, at 300, the support tracks 110 may be fastened to the support structure of the building. At 310, the gasket 200 may be coupled to the support tracks 110. For example, the first and second arms 208, 210 of the gasket 200 may be coupled to the first and second channels 134, 136 defined by the first and second legs 130, 132 of the support tracks 110. At 320, individual tiles 50 may be coupled to the support tracks 110. For example, utilizing integrally formed support tracks 110 with punched clips 150, each tile 50 may be coupled to the support tracks 110 by movably (e.g., slidably) positioning the top edge portion 56 of each tile 50 into the first, downwardly extending channel 154 of the clips 150. Thereafter, the bottom edge portion 58 of the tile 50 may be positioned relative to the second, upwardly extending channel 158 of the clips 150. Next, the tile 50 may be moved so that the bottom edge portion 58 of the tile 50 sits within the second, upwardly extending channel 158 of the clips 150. Thus arranged, the tile 50 is coupled to the support tracks 110 via the interaction of the first, downwardly extending channel 154 and the second, upwardly extending channel 158 with the tiles 50. Additional, outward force provided by the gasket 200 ensures that the tiles 50 are securely held in place. No additional coupling is needed. Additionally, by utilizing the coupling system 100 and method disclosed herein, easy and fast replacement of individual tiles 50 is achievable. Optionally, separately formed clips may be installed where necessary, for example, adjacent to windows or the top row of tiles, where due to the installed height of the building, the support track may require cutting.

In use, by utilizing a coupling system 100 including one or more aspects of the present disclosure, a number of benefits can be achieved. First, by integrally forming the clips 150 and/or the first and second legs 130, 132 with the support tracks 110, individually forming and coupling clips to the support tracks is eliminated thereby greatly reducing the cost of manufacturing and installing the system particularly when installing smaller tiles, which requires larger number of clips to be installed. Second, by enabling the tiles 50 to be slidably inserted into the first, downwardly extending channel 154 and the second, upwardly extending channel 158 formed by the clips 150, faster and easier installation is achievable further reducing the cost of installing the system. Third, by enabling the tiles 50 to be slidably inserted into the first and second channels 154, 158 formed by the clips 150, individual replacement of each tile 50 is achievable (e.g., individual tiles can be easily removed by moving (e.g., sliding) tiles upward and out). Fourth, by coupling the clips 150 to the front surface 52 of the top edge portion 56 of the tiles 50, reduced risk of damage to the tiles is achievable. In addition, undetected instances of damage to the tile 50 is minimized as compared to prior art coupling systems that coupled exclusively to grooves formed in the back surface of the tile, where the tile may become damaged during installation but not detected. Moreover, by providing wider clips 150 for coupling with the tiles 50 and/or by coupling with the front surface 52 of the tile 50, better load distribution is achievable enabling the coupling system 100 to handle higher wind loads.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

The foregoing description has broad application. Accordingly, the discussion of any embodiment is meant only to be explanatory and is not intended to suggest that the scope of the disclosure, including the claims, is limited to these example embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The term "a" or "an" entity, as used herein, refers to one or more of that entity. As such, the terms "a" (or "an"), "one or more" and "at least one" can be used interchangeably herein. The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein. The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority but are used to distinguish one feature from another. The drawings are for purposes of illustration only and the dimensions, positions, order and relative sizes reflected in the drawings attached hereto may vary.

The invention claimed is:

1. A coupling system arranged and configured to couple a plurality of tiles to a building, said coupling system comprising:

a plurality of support tracks arranged and configured to be coupled to the building, said support tracks including a base, first and second sidewalls extending from said base, and first and second flanges extending from said first and second sidewalls, respectively, and spaced from said base; and a gasket arranged and configured to couple to the support tracks;

wherein:

each of said first and second flanges of said support tracks includes a plurality of clips arranged and configured to couple with the tiles;

each of the plurality of clips is integrally formed with said first and second flanges of said support tracks;

each of said plurality of clips includes a first, downwardly extending channel arranged and configured to couple to a top edge portion of a lower tile and a second, upwardly extending channel arranged and configured to couple to a bottom edge portion of an upper tile;

said first and second sidewalls of said support tracks include first and second inwardly extending legs, respectively, arranged and configured to couple to said gasket; and said gasket includes a base including a front surface and a rear surface, and first and second arms extending from said rear surface of said base of said gasket, said first and second arms being arranged and configured to be received by said first and second inwardly extending legs, respectively, of said support track to couple said gasket to said support tracks.

2. The coupling system of claim 1, wherein said first, downwardly extending channel includes a recess having a depth extending a first distance, while the second, upwardly extending channel includes a recess having a depth extending a second distance less than said first distance.

3. The coupling system of claim 1, wherein said first and second inwardly extending legs are integrally formed with said support tracks.

4. The coupling system of claim 1, wherein said gasket further includes one or more bulbous sections extending from said front surface of said base of said gasket.

5. The coupling system of claim 4, wherein said gasket is arranged and configured to apply outward pressure against the tiles thereby pressing the tiles against said plurality of clips.

6. The coupling system of claim 5, wherein said bulbous sections of said gasket are manufactured from an elastomer having a first Shore A hardness, said base of said gasket is manufactured from an elastomer having a second Shore A hardness greater than said first Shore A hardness.

7. The coupling system of claim 1, wherein said first and second sidewall are spaced from the base in a direction perpendicular to a plane of said base.

8. A coupling system arranged and configured to couple a plurality of tiles to a building, said coupling system comprising:

a plurality of support tracks arranged and configured to couple to the building, said support tracks including a base, first and second sidewalls extending from said base, and first and second flanges extending from said first and second sidewalls, respectively, and spaced from said base;

a plurality of clips arranged and configured to couple with the tiles, said plurality of clips being operatively associated with each of said first and second flanges of said support tracks; and a gasket arranged and configured to couple to said support tracks;

wherein:

said first and second sidewalls of said support tracks include first and second inwardly extending legs, respectively, arranged and configured to couple to said gasket;

said gasket includes a base including a front surface and a rear surface, and first and second arms extending from said rear surface of said base of said gasket, said first and second arms being arranged and configured to be received by said first and second inwardly extending legs, respectively, of said support tracks to couple said gasket to said support tracks; and said first and second inwardly extending legs are integrally formed with said support tracks.

9. The coupling system of claim 8, wherein each of said plurality of clips is integrally formed with said first and second flanges of said support tracks.

10. The coupling system of claim 9, wherein each of said plurality of clips include a first, downwardly extending channel arranged and configured to couple to a top edge portion of a lower tile and a second, upwardly extending channel arranged and configured to couple to a bottom edge portion of an upper tile.

11. The coupling system of claim 10, wherein said first, downwardly extending channel includes a recess having a depth extending a first distance while the second, upwardly extending channel includes a recess having a depth extending a second distance less than said first distance.

12. The coupling system of claim 8, wherein said gasket further includes one or more sections extending from said front surface of said base of said gasket.

13. The coupling system of claim 12, wherein said sections of said gasket are manufactured from an elastomer having a first Shore A hardness, said base of said gasket is manufactured from an elastomer having a second Shore A hardness greater than said first Shore A hardness.

14. The coupling system of claim 8, wherein said first and second sidewall are spaced from the base in a direction perpendicular to a plane of said base.

15. A system arranged and configured to couple a plurality of tiles to a building, said system comprising:

a plurality of tiles including an upper tile and a lower tile, each tile including a top edge portion and a bottom edge portion;

a plurality of support tracks arranged and configured to be coupled to the building, said support tracks including a base, first and second sidewalls extending from said base, and first and second flanges extending from said first and second sidewalls, respectively; and a plurality of gaskets, each gasket being arranged and configured to couple to one of said support tracks via a snap fitted connection;

wherein:

each of said first and second flanges of said support tracks includes a plurality of clips arranged and configured to couple with one of the plurality of tiles;

each of the plurality of clips is integrally formed with said first and second flanges of said support tracks; and each of said plurality of clips include a first, downwardly extending channel arranged and configured to hold said top edge portion of said lower tile and a second, upwardly extending channel arranged and configured to hold said bottom edge portion of said upper tile.

16. The system of claim 15, wherein said plurality of clips are arranged and configured to hold said bottom edge portion of said upper tile and said top edge portion of said lower tile so that said bottom edge portion of said upper tile overlaps with said top edge portion of said lower tile.

17. A method for coupling a plurality of tiles to a building, said method comprising:

coupling a plurality of support tracks to a support structure of the building, said plurality of support tracks being spaced horizontally across a width of the building;

coupling a gasket to each of said plurality of support tracks by snap-fitting said gasket to said support track;

slidably inserting a top edge portion of a first tile into a first, downwardly extending channel formed on said support tracks; and slidably inserting a bottom edge portion of said first tile into a second, upwardly extending channel on said support tracks.

* * * * *